United States Patent [19]

Gully

[11] 4,127,054

[45] Nov. 28, 1978

[54] POWDER LEVEL INSPECTION SYSTEM WITH MAGNETIC LATCHING DEVICE

[75] Inventor: Lanny L. Gully, Richmond, Mo.

[73] Assignee: Remington Arms Company, Inc., Bridgeport, Conn.

[21] Appl. No.: 845,498

[22] Filed: Oct. 26, 1977

[51] Int. Cl.[2] ..... F42B 33/02

[52] U.S. Cl. ..... 86/23; 86/1 R; 86/29

[58] Field of Search ..... 141/DIG. 1, 94, 95; 116/124 R, 124 A, 209; 86/1, 23, 29–33

[56] References Cited

U.S. PATENT DOCUMENTS

| | | | |
|---|---|---|---|
| 3,019,688 | 2/1962 | Hunt | 86/23 |
| 3,153,976 | 10/1964 | Linder | 86/26 |
| 3,952,628 | 4/1976 | Boswell | 86/1 R |

*Primary Examiner*—Harold J. Tudor

*Attorney, Agent, or Firm*—William L. Ericson; Nicholas Skovran

[57] ABSTRACT

A magnetically-actuated latching device for use in a powder level inspection system known per se, in which a holding plate slidably supports a number of probes in a pattern similar to an array of ammunition cases in a loading plate, and the holding plate is lowered by an elevator mechanism to insert the probes into the mouths of the cases. The probes signal the level of powder in the cases by rising out of the holding plate to proportionate heights. The improvement involves the use of magnetic probes which, upon encountering low or missing powder charges, actuate magnetic latches to prevent the loading plate from being separated from the holding plate. The operator's attention is forcibly called to the presence of low powder charges by the necessity to release the latches with a hand-held magnet.

8 Claims, 3 Drawing Figures

POWDER LEVEL INSPECTION SYSTEM WITH MAGNETIC LATCHING DEVICE

BACKGROUND OF THE INVENTION

This invention relates to the manufacture of ammunition, and specifically to the inspection of the level of propellant powder which has been metered into empty ammunition casings.

The invention is particularly applicable to an otherwise-conventional process of loading and assembling cartridges in batches set up in loading plates. These plates are made up of a container and a cover having a number of holes arranged in a rectangular pattern; an equal number of empty primed cartridge cases are first placed in the container, each with its open mouth received in one of the holes of the cover. The assembled loading plate is inserted beneath a powder metering device, which has a number of volumetric metering chambers arranged in the same pattern as the holes of the loading plate, so that one chamber aligns above each empty cartridge case. A powder hopper open at the bottom is wiped across an upper surface of the powder metering device to fill each metering chamber with a charge of powder. The bottoms of the chambers are closed during this filling operation by a perforated slide, which is then opened to permit the powder charges to flow into the waiting cartridge cases beneath.

It sometimes happens that the supply of powder in the hopper is depleted during the filling of a loading plate, and for this or other reasons some of the cartridge cases do not receive a full charge of powder. It is therefore necessary to inspect the powder levels in the cases after the metering operation, and before the cartridges are completed by inserting and crimping bullets. Conventionally, this inspection employs a holding plate having the same number and pattern of holes as the loading plate, and a similar number of probes slidably received in the holes of the holding plate. The loading plate is positioned beneath the holding plate, which is then lowered by a manual crank mechanism to insert the probes into the mouths of the cartridge cases. Each probe which encounters a powder charge is lifted from its seat in the holding plate, to a height which indicates the height of the charge. An operator then visually ascertains whether all of the probes are raised to the same height; if not, the entire batch of cartridges in the charging plate must be rejected and recharged. Careful and continuous attention is required if the assembly of some cartridges with missing or reduced powder charges is to be avoided.

BRIEF DESCRIPTION OF THE INVENTION

It is the primary object of this invention to increase the reliability of inspection of powder charges in ammunition loading operations. It is a more specific object to provide an improved powder charge detection system which increases the assurance that a loading plate containing cartridges with low or missing charges will be noticed by an operator, rather than being inadvertently passed on as a correctly-loaded plate. Further objects and advantages will become apparent as the following description proceeds.

I employ the conventional loading and holding plates, and a known crank-operated elevator mechanism for lowering the holding plate in registered relation onto the loading plate, so as to lower the probes carried by the holding plate into the charged cartridge cases contained into the loading plate. However, I replace one or more of the conventional probes with magnetic probes which are of the same size and shape, but contain permanent magnets. I also attach a magnetic latch device to the holding plate adjacent to each of the magnetic probes. This device comprises a magnetic latch pin slidably received in a cage, for movement between a retracted position in which it is closely juxtaposed to the path of vertical movement of the corresponding magnetic probe, and an extended position in which, when the holding plate is fully lowered, it engages a catch and thereby prevents the holding plate from being re-elevated.

In the event that the magnetic probes encounter properly-charged cartridge cases in the loading plate, they rise from the descending holding plate, and do not approach the magnetic latch pins closely enough to move them from their retracted positions. This permits the holding plate to be raised by the elevator mechanism in a normal fashion after the inspection. However, if a magnetic probe enters a case with a low or missing powder charge, it descends into sufficiently close proximity to an adjacent magnetic latch pin to repel the latter to its extended position, the adjacent poles of the probe and latch pin being arranged in opposition for this purpose. The holding plate is thereby latched in its lowered position, with its probes extended into the ammunition cases, and the loading plate cannot be removed until the latch pins are restored to their retracted positions. This necessitates corrective action by the operator, and thereby forcefully calls his attention to the presence of defectively-loaded cartridges, so that they are not likely to pass the inspection through simple inadvertence. Using hand-held magnets, the operator first withdraws the magnetic probes from the holding plate, and then restores the magnetic latch pins to their retracted positions; the elevator mechanism can then be actuated to raise the holding plate and thereby release the charging plate from the remaining, non-magnetic probes.

DESCRIPTION OF THE PREFERRED EMBODIMENT

Figure 1:
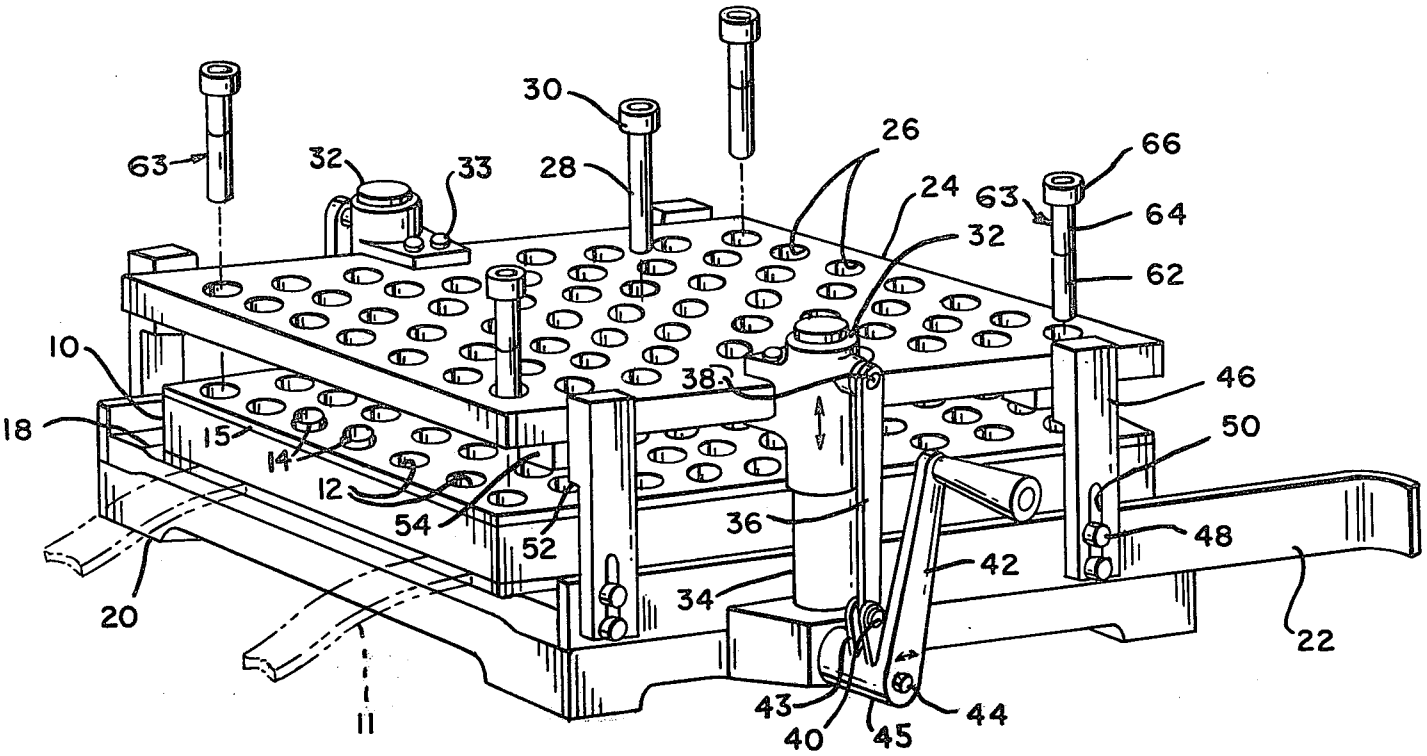
FIG. 1 is a view in perspective of a powder-level inspection mechanism incorporating my invention.

The improved inspection device is incorporated into a conventional mechanism for inspecting the level of powder 16 previously charged into a batch of cartridge cases 14 contained in a loading plate 10. The cases are located in the loading plate by a pattern of holes 12 in a cover plate 15, and their open mouths project upwardly through these holes.

The loading plate is slidably supported on a base 20, and is manually positioned between guideways 18 and against rocker arms 11, which are displaced downwardly after the inspection is completed to permit the loading plate to be removed for further processing. The guideways 18 and rocker arms 11 locate the pattern of holes 12 in vertical alignment beneath a similar pattern of counterbored holes 26 in a holding plate 24. Each of the holes 26 slidably receives a probe 28 having an enlarged head 30, which normally seats in the counterbore so that the probe extends downwardly from the holding plate.

The holding plate 24 is mounted in a pair of brackets 32 by screws 33, and the brackets are vertically slidable on posts 34 secured to the base 20. An elevator mechanism is provided for raising and lowering the holding plate between the positions 24*a* and 24*b* (FIG. 2); this mechanism includes a pair of links 36 each pivotally connected to a corresponding one of the brackets 32 by a pin 38. A crank 45 having an operating handle 42 is secured to an axle 44, which is rotatably received in the base 20, extends across the base, and is secured to a second crank (not shown) that is similar to the crank 45 but need not have an operating handle. Both cranks have arms 43 pivotally connected to the links 36 by pins 40, and forming an over-center toggle linkage therewith. The handle 42 may be turned in a clockwise direction from a terminal position shown in FIG. 1, in which the holding plate 24 is locked in the raised position 24*a* of FIG. 2, to bring the holding plate to its lowered position 24*b*.

Figure 2:
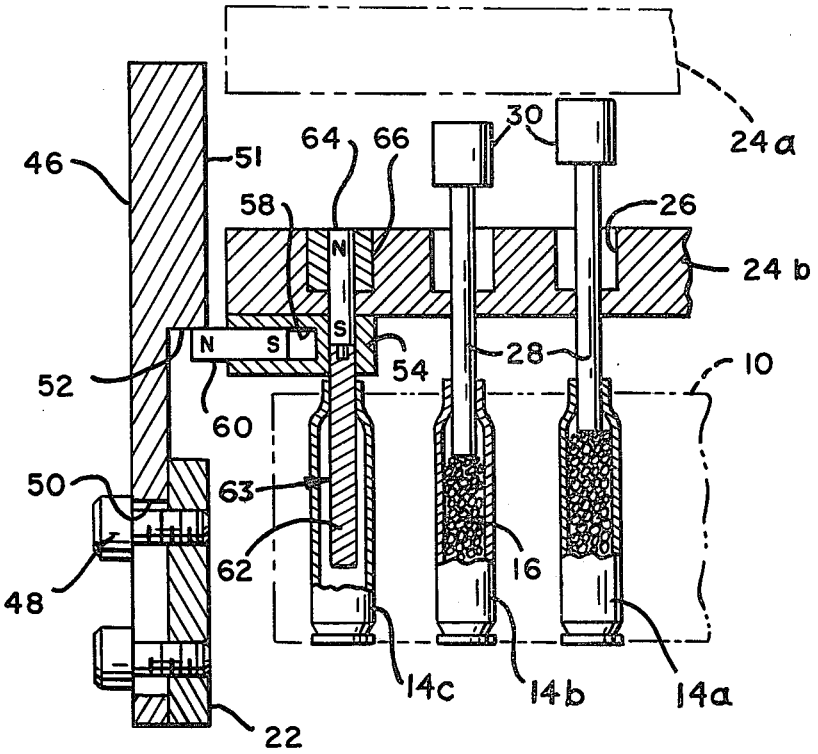
FIG. 2 is a fragmentary sectional view in elevation, showing the operation of a magnetic latching device.

As the holding plate is lowered, the probes 28 enter the open mouths of the cases 14, as shown in FIG. 2. A probe which encounters a normal level of powder, as in a case 14*a*, is raised from its seat to a higher elevation than a probe which encounters a low charge, as in a case 14*b*; and if there is no powder in the case, as at 14*c*, the probe remains seated in the holding plate. This gives the operator a visual signal of any low or missing charges; he then turns the crank handle 42 to raise the holding plate and its probes from the cartridge cases, and removes the loading plate for appropriate disposition. The mechanism as thus far described is conventional, and forms no part of the present invention.

According to my invention, one or more of the probes 28 are replaced by magnetic probes 63. I prefer to employ four of the magnetic probes, one located at each corner of the pattern of holes 26. The probe 63 has the same exterior configuration as a conventional probe 28, but it incorporates a magnetic element 64 secured to non-magnetic elements comprising an annular head 66 and a pin portion 62.

I also mount a cage 54, bored at 56 for passage of the probe 63, under the holding plate 24 adjacent to each hole 26 which is selected to receive one of the magnetic probes. The cage has a recess 58 in which a magnetic latch pin 60 is slidably received for movement between an extended position shown in FIG. 2, and a retracted position shown in FIG. 3. Similar poles of the magnets 60 and 64 are positioned adjacent to one another as shown, so that the magnetic latch pin 60 is repelled toward its extended position when the magnetic element 64 approaches within a certain distance from it.

A bar 46 having a planar wall 51 interrupted by a recessed catch portion 52 is associated with each latch pin 60; these bars are mounted on guide rails 22 attached to the sides of the base 20, by adjustable means comprising screws 48 received through elongated slots 50.

Figure 3:
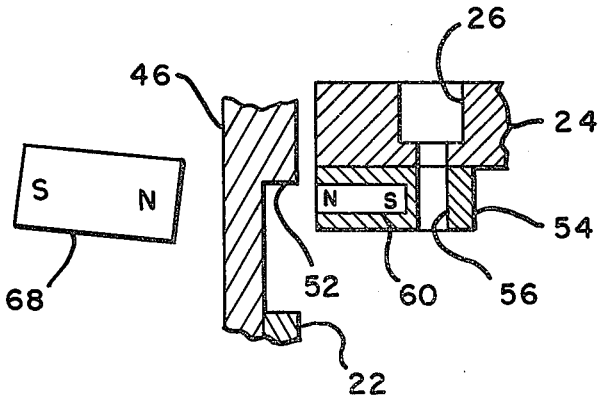
FIG. 3 is a fragmentary sectional view showing the method of releasing the latching device of FIG. 2.

In operation, a magnetic probe 63 which encounters a normal level of powder in a case when the holding plate is lowered to 24*b*, is arrested in an elevated position similar to that of the probe 28 shown in the case 14*a*. The distance between the magnets 64 and 60 is great enough in this situation that the latter is not impelled to depart from its normal position, retracted into the cage 54 as shown in FIG. 3. Consequently, the subsequent upward movement of the holding plate will not be impeded by the magnetic latch pin 60.

If, however, the case contains less than a normal powder charge, the probe 63 will fall to some lower elevation, such as depicted in the cases 14*b* or 14*c*. The field strengths of the magnetic elements 60 and 64 are selected so that this closer approach between their opposed poles will repel the magnetic latch pin 60 toward its extended position, that is, toward the left in FIG. 2; and it will engage under the catch 52 as the holding plate arrives at 24*b*.

This prevents any upward motion of the holding plate by the crank handle 42, and the probes 28 and 63 lock the loading plate in place so that it cannot be withdrawn without correction action by the operator. This action consists in using a hand-held magnet 68 to withdraw the magnetic probes 63 from the holding plate, and then using the same magnet to repel the magnetic latch pins 60 toward their retracted positions, as shown in FIG. 3. Releasing the latch pins permits the holding plate to be raised in a normal fashion, so that the defective cartridges in the loading plate can be rejected.

While this magnetic latching device can be applied to additional probes, I believe it is adequate to limit its use to the probes at the four corners of the loading plate. The usual cause of low or missing charges is the depletion of powder in the loading hopper, and the effects of this are certain to appear in the last row of cartridge cases filled as the hopper is wiped across the powder metering device.

What I claim is:

1. For use in a mechanism for inspecting the level of powder contained in ammunition cases, which comprises a loading plate supporting a batch of the cases in a predetermined pattern, a holding plate having a pattern of holes similar to said predetermined pattern, a series of probes slidably received in said holes, and an elevator mechanism for supporting and selectively moving said holding plate between a raised position and a lowered position, said elevator mechanism supporting said holding plate with the probes therein aligned to enter the cases in said loading plate as said holding plate approaches said lowered position, whereupon those probes which encounter a normal level of powder in the cases will become elevated to a normal height higher than those probes which encounter a low or missing powder charge the improvement which comprises:

at least one of said probes comprising a first magnet;

a latch member comprising a second magnet;

means supporting said latch member on said holding plate for movement between an extended and a retracted position; and catch means forming a catch cooperable with said latch member, when said holding plate is in said lowered position and said latch member is in said extended position, to latch said holding plate in said lowered position; said magnets being selected and positioned such that said one probe repels said latch member from said retracted position toward said extended position in the event said one probe reaches a height lower than said normal height when said holding plate is in said lowered position.

2. The combination recited in claim 1, said latch member being constructed and arranged to be selectively impelled toward said retracted position thereof by an externally-manipulated magnet.

3. The combination recited in claim 1, said supporting means comprising a cage secured to said holding plate and having a recess receiving said latch member in frictional sliding engagement therein.

4. The combination recited in claim 1, said catch means being formed with a planar wall extending substantially parallel to the path of movement of said holding plate and interrupted by a recess forming said catch at a height to be engaged by said latch member when said holding plate is in said lowered position.

5. The combination recited in claim 1, a plurality of said probes comprising magnets, together with a plurality of said latch members, supporting means, and catch means spaced apart about the periphery of said holding plate for cooperation with said plurality of said probes.

6. The combination recited in claim 5, said predetermined pattern being substantially rectangular, four of said probes comprising magnets, four sets of said latch members, supporting means, and catch means being located adjacent to the corners of said pattern for cooperation with said four probes received in holes at said corners.

7. The combination recited in claim 1, said one probe comprising a pin portion and an enlarged head portion secured to an upper end of said pin portion, a segment of said pin portion comprising a magnet and the remainder of said probe being formed of non-magnetic material.

8. For use in a mechanism for inspecting the level of powder contained in ammunition cases, which comprises a loading plate supporting a batch of the cases in a predetermined pattern, a holding plate having a pattern of holes similar to said predetermined pattern, a series of probes slidably received in said holes, and an elevator mechanism for supporting and selectively moving said holding plate between a raised position and a lowered position, said elevator mechanism supporting said holding plate with the probes therein aligned to enter the case in said loading plate as said holding plate approaches said lowered position, whereupon those probes which encounter a normal level of powder in the cases will be lifted from said holding plate to a normal height higher than those probes which encounter a low or missing powder charge;

the improvement which comprises:

a first magnet element secured to one of said probes, a second magnet element comprising a latch pin, means secured to said holding plate supporting said latch pin for movement between an extended and a normal retracted position relative thereto, and stationary catch means cooperable with said latch pin in the extended position thereof to latch said holding plate in place upon movement thereof to said lowered position; said magnet elements being arranged, and relatively positioned when said holding plate is in said lowered position, such that in the event said one probe encounters a normal level of powder in a case said second magnet element remains in said normal retracted position, but that in the event said one probe encounters a lower-than-normal level of powder in a case, and therefore falls below said normal height, said second magnet element will be repelled by said first magnet element to said extended position to latch said holding plate in said lowered position.

* * * * *